United States Patent [19]

Cohen et al.

[11] Patent Number: 5,009,239

[45] Date of Patent: Apr. 23, 1991

[54] SELECTIVE DELIVERY AND RETENTION OF ALDEHYDE AND NICOTINE BY-PRODUCT FROM CIGARETTE SMOKE

[75] Inventors: Richmond R. Cohen, Hockessin; Gary A. Luzio, Bear, both of Del.

[73] Assignee: Hoechst Celanese Corporation, Bridgewater, N.J.

[21] Appl. No.: 286,687

[22] Filed: Dec. 20, 1988

[51] Int. Cl.[5] ..... A24D 3/06; A24D 3/08; A24D 3/14

[52] U.S. Cl. ..... 131/342; 131/332; 131/341; 131/345; 493/47; 493/49

[58] Field of Search ..... 131/331, 332, 339, 340, 131/341, 342; 493/47, 49

[56] References Cited

U.S. PATENT DOCUMENTS

| | | | |
|---|---|---|---|
| Re. 28,858 | 6/1976 | Litzinger . | |
| 3,340,879 | 9/1967 | Horsewell et al. . | |
| 3,393,685 | 7/1968 | Mumpower et al. | 131/341 |
| 3,403,690 | 10/1968 | Horsewell . | |
| 3,428,056 | 2/1969 | Sublett et al. . | |
| 3,434,479 | 3/1969 | Till et al. . | |
| 3,605,759 | 9/1971 | Owens . | |
| 3,716,063 | 2/1973 | Litzinger . | |
| 4,246,910 | 1/1981 | Rainer et al. . | |
| 4,266,561 | 5/1981 | Litzinger . | |

FOREIGN PATENT DOCUMENTS

| | | |
|---|---|---|
| 3200068 | 1/1982 | Fed. Rep. of Germany . |

*Primary Examiner*—V. Millin

[57] ABSTRACT

A process for improving selective filter retention and pass through properties of cigarette filter elements by treating with polyethyleneimine modified to a predetermined pH range with one or more indicated water soluble organic acids, as a filter modifier composition, and the corresponding filter element and cigarette.

24 Claims, 2 Drawing Sheets

Figure 1:
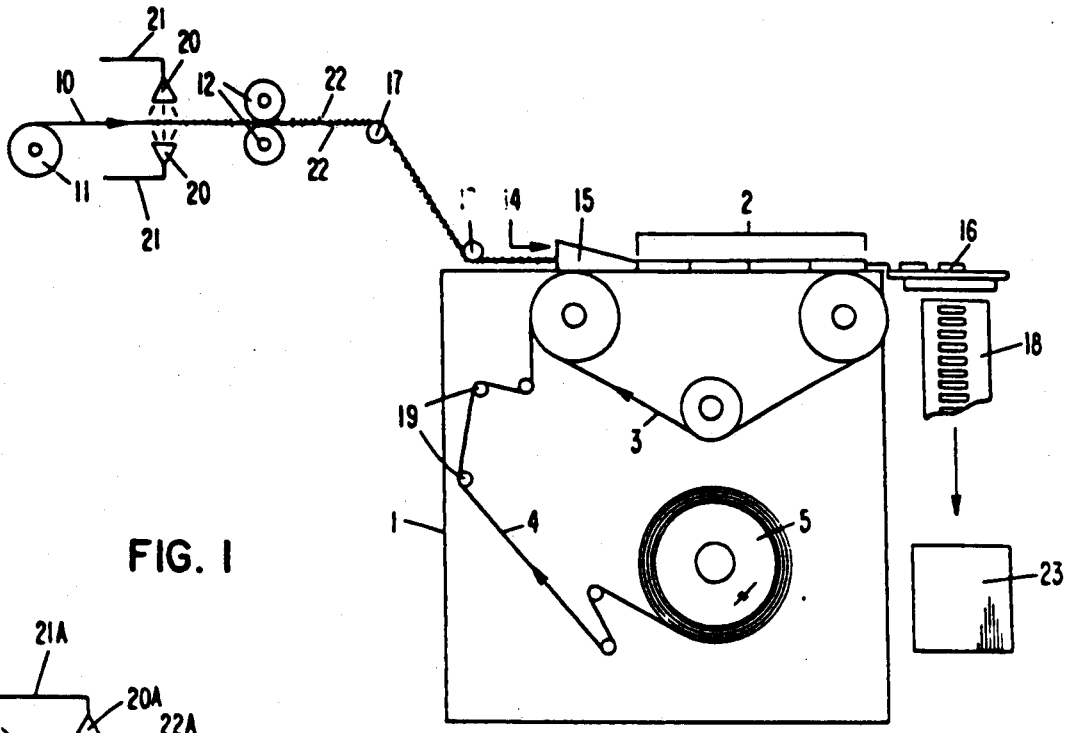

SELECTIVE DELIVERY AND RETENTION OF ALDEHYDE AND NICOTINE BY-PRODUCT FROM CIGARETTE SMOKE

The present invention relates to a cigarette filter element and method for improving both selective retention and pass-through properties thereof by treating with a filter modifier composition.

BACKGROUND

Although fiber-based cigarette filter elements are well known, the choice of components for such filters has remained quite limited, over the years, because of cost factors and the lack of suitability of many natural fibers for high speed filter production, using state of the art filter rod-making apparatus. In addition, the functional requirements of modern cigarette filter elements tend to conflict with respect to filtration efficiency and selective filtration of cigarette smoke. In particular it is desired to pass along flavor while limiting delivery of less desired smoke by-products.

While various synthetic fibers and fiber mixtures have been tried and evaluated as filter components, a substantial number of modern cigarette filter elements continue to use old technology and well known substrates because of cost and handling advantages. For example, cellulose acetate tow using a variety of additives can be processed into cuttable filter rods using an essentially unmodified state-of-the-art filter rod-making apparatus without serious jamming problems. This advantage is useful in view of the increased need for additives, including organic plasticizers such as triacetin and diacetin, as well as lubricants, flavors, medicines, and particularly selective filtering additives. Generally, such compositions are directly applied onto fiber tow in the form of aqueous solutions or suspensions by using art-recognized dipping, spraying, or printing techniques.

The advantages of cellulose acetate fiber as filter substrate, however, are countered by serious disadvantages. For example, such fibers tend to be relatively weak, compared with synthetic thermoplastic fiber such as polyolefin fiber. This characteristic limits the amount of tension and crimp that a fiber tow of low dpf fiber or filament will tolerate before introduction into a filter rod-making apparatus. This, in turn, can limit the structural integrity or hardness of the filter.

Synthetic thermoplastic fiber components, particularly polyolefins such as polypropylene staple, when used alone or in combination with cellulose, offer an alternative since they are easily drawn to smaller denier and thereby, offer a potentially high general filter efficiency without serious loss in strength and the above-noted crimping problems and tension under high speed production conditions.

Such artificial thermoplastic fibers, however, also have disadvantages. These generally arise from the fact that such candidates, particularly polyolefins, are hydrophobic and tend to be chemically inert, while a majority of known cigarette filter additives, as above noted, are hydrophilic and difficult to retain in proper amount and functional condition within filter elements containing hydrophobic synthetic fiber as a major component.

Another substantial problem, unique to the cigarette filter art, concerns the difficulty in optimizing fiber denier and general filter efficiency of synthetic fiber filters without corresponding sacrifice in dimensional stability, hardness, and draw (pressure drop) properties across the filter element.

These technical problems are on-going and interrelated, such that attempted improvements in one area usually require difficult choices in others.

It is an object of the present invention to obtain improved cigarette filter elements having superior selective filter retention and pass through properties without sacrificing dimensional stability or general filter efficiency.

It is a further object of the present invention to obtain cigarette filters having improved selective aldehyde filter retention control coupled with significantly increased filter pass through or delivery of flavor components such as nicotine.

THE INVENTION

The above objects are obtained in accordance with the instant process for improving both selective aldehyde filter retention and nicotine pass through properties of a cigarette filter element having at least one synthetic thermoplastic fiber- or thermoplastic film-containing substrate material comprising:

(a) directly treating the substrate material with an effective amount of a filter modifier composition comprising
  (1) polyethyleneimine ("PEI") together with
  (2) an organic acid selected from at least one of formic, propionic, butyric, lactic, benzoic and acetic acid; in an amount sufficient to obtain a buffered composition within a pH range of about pH 4 to about pH 9.5; and (b) completing fabrication of the desired filter element;

whereby selective filter retention of aldehyde smoke components and selective delivery or filter pass through of nicotine smoke components are promoted in combination.

General filter efficiency, including percent removal of nicotine, tar, and general particulate matter, depends substantially upon fiber denier, filter density, and length. Selective filtration properties such as removal of aldehyde by products, however, tend to be less easily categorized and predicted, particularly if multi-selective filtration properties are desired which favor the delivery of flavors (i.e. nicotine) along with the improved aldehyde filter retention. To achieve dual selective filter control in a single filter element without also changing the fiber content and hardness characteristics represents a valuable and unique development which is here obtained by treating the filter with a modifier composition obtained by combining PEI with sufficient designated organic acid (preferably water soluble acid) to obtain a buffered filter modifier composition falling within the above-noted pH range of about pH 4.0 to about pH 9.5. Optimum pH values for each modifier compositions will vary somewhat according to the choice of filter substrate, its treatment, including drying and storage conditions, and the particular organic acid(s) used. The most effective PEI/formic acid modifier composition, however, has a pH range of about 8–9.5, the substrate being dried and stored at 55–65% relative humidity. In general, modifier compositions having a pH in excess of pH 8, are found to be particularly beneficial since substantially less filter discoloration is encountered than obtained at lower pH ranges.

An "effective amount" of active filter modifier composition, for purposes of the present invention, is further defined as an amount of composition utilizing the above pH-defined ratio of PEI-to-acid and use of an amount of filter modifier composition totaling about 5-50% by weight or more, and preferably about 5-25%, based on total weight of dry filter substrate.

Cigarette filter elements of the present invention comprise compressed and wrapped tow plugs of one or more of synthetic thermoplastic-containing substrate such as a fiber- or film forming polyolefin, polyester or polyamide, alone or in combination with cellulose acetate, said plugs having incorporated therein an effective amount of the abovedescribed filter modifier composition.

Also within the scope of the present invention are filter elements containing surfactant material of about 0.1%-10% and preferably 0.5%-10% by weight of one or more of a class described as (1) a polyoxyalkylene derivative of a sorbitan fatty acid ester, (2) a fatty acid monoester of a polyhydroxy-alcohol, or (3) a fatty acid diester of a polyhydroxy alcohol.

Suitable surfactants for such purpose can include, for instance, ethoxylates, carboxylic acid esters, glycerol esters, polyoxyethylene esters, anhydrosorbitol esters, ethoxylated anhydrosorbitol esters, ethoxylated natural fats, oils and waxes, glycol esters of fatty acids, polyoxyethylene fatty acid amides, polyalkylene oxide block copolymers, poly(oxyethylene-co-oxypropylene) and the like.

In addition to modifier composition and surfactants there may be included aqueous solutions, suspensions or dispersions of one or more humectants exemplified by polyhydric alcohols such as glycerols, glycols etc.; flavors and perfumes such as ketoses and polysaccharides, including wintergreen, spearmint, peppermint, chocolate, licorice, cinnamon, fruit flavors, citrus etc.; medicines such as menthol and decongestants; and other art-recognized additives as found, for instance, in U.S. PAT. NOS. 4,485,828 and 4,715,390.

The term "substrate" as above used, includes a fiber- or film- containing garniture feed suitable for a filter rod-making apparatus, including one or more of opened fiber tow of cellulose acetate or thermoplastic synthetic fiber of the mono- , or bi-component type, inclusive of side-by-side and sheath/core configurations preferably having a sheath of lower melting point than the core. Such feeds are conveniently introduced alone or in complete or partial register (see FIGS. 2 and 3) for insertion into the garniture of a conventional or modified filter rod-making apparatus.

Suitable garniture feed can conveniently include from one up to about four or more webs of substrate component(s) of a homogeneous or mixed variety, the desired active components being applied onto one or both faces of selected substrates, and the manner and number of faces treated depending upon desired filter selectivity and efficiency, plus feel, hardness, and draw characteristics. In such instance, application of additives to the substrate(s) can again be effected by dipping, spraying or even by drawing a solution through a formed filter rod or element, using a partial vacuum. The resulting treated filters are then normally oven dried under controlled humidity conditions as above noted.

For purposes of the present invention, it is immaterial whether garniture feed is fabricated in situ, (i.e. immediately upstream of the garniture) or earlier produced and stored before use.

It is also found convenient to use one or more nonwoven fabrics of the same or different fiber composition and denier (3-10 dpf) as substrate for garniture feed, particularly if not all of the substrate in the filter element is to be used as a carrier surface for filter modifier composition or other additives.

When a ribbon of a fabric or fiber tow is used as garniture feed component in accordance with the present invention, such may comprise about 5%-100% by weight of thermoplastic synthetic-containing substrate, preferably a polyolefin, including mono-, or bi-component fiber of side-by-side and sheath/core types, and may consist of webs or tows having filaments of homogeneous or mixed denier, or combinations of fibers such as (a) polypropylene/polyethylene, polypropyl- ene/-polyvinylidene chloride, polypropylene/cellulose acetate, polypropylene/rayon, polypropylene/nylon, cellulose acetate/polyethylene, plasticized cellulose acetate, polypropylene/- paper; or (b) polypropylene/-polystyrene/polyethylene, and the like, in preferred ratios of about (a) 10%-90% 90%-10% or (b) 10%-90%/45%-5%/45%-5% based on substrate weight, in the manner described, for instance, in U.S. Pat. No. 3,393,685.

Generally speaking suitable nonwoven material falls within a weight range of about 10-50 grams per $m^2$, and a ribbon width of about 4"-12" (of either type) will provide successful passage through the garniture of a conventional filter rod-making apparatus operating at production speeds.

Fibrillated film can also be employed as a substrate component for use alone or in combination with other abovelisted substrate components as garniture feed within the present invention. Such can be obtained, for instance, in accordance with components disclosed in U.S. Pat. Nos. 4,151,886 and 4,310,594 (Yamazaki) and U.S. Pat. No. 3,576,931 (Chopra).

A conventional filter rod-making apparatus suitable for present purposes can comprise a tow trumpet, garniture, shaping means, wrapping means, and cutting means in accordance with components and processes generally described, for instance, in U.S. Pat. No. 3,144,023 and U.S. Pat. No. 2,794,480. If desired, however, modifications can be made to permit in-situ or prior spraying, dipping, printing, vacuum draw, or other traditional substrate application methods, as above described, for introducing one or more modifier components of the present invention prior to or after the formation of a filter plug.

As above-noted, a garniture feed may comprise up to about 4 or even more substrate webs of identical or different weight, dimensions, bonding properties, absorption properties, fiber composition, and fiber denier; moreover the webs can be introduced wholly or partly in register and in machine, cross, or diagonal directions. For best results, however, one relatively lightly thermally bonded fabric, tow, sliver or fibrillated film in register with one nonwoven fabric, or between two nonwoven fabrics is found to offer a high degree of flexibility for adapting the resulting filter element to a variety of market needs, including cost, and recognized filter draw, and hardness parameters.

The inclusion of an additional low melting fiber such as polyethylene, combined with other polyolefin fiber as garniture feed is also found useful for obtaining tow plugs of widely varying bonding and adsorption properties.

Cost-wise, opened fiber tow and nonwoven ribbons are found especially useful in this invention since they permit the use of relatively cheap polyolefin webs of mixed denier, and simplify the need for a precise distribution of modifier components within a filter element. This is accomplished without the need for abandoning art-recognized techniques and equipment such as printing rolls and spray heads for substrate coating.

Figure 3:
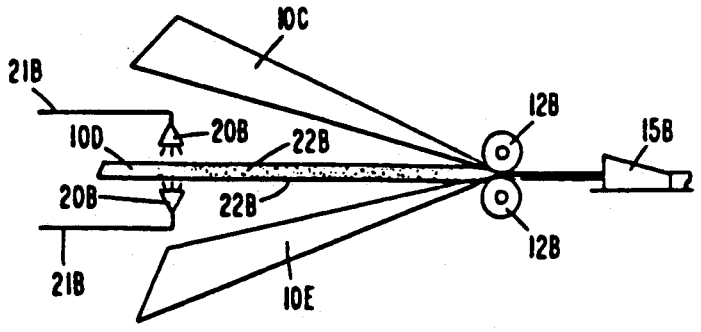

In order to maintain precise control over application of additives within the present invention, it is also found useful if the substrate is carefully controlled with respect to moisture content before conversion into a filter element. In addition, the filter element, and applied additive components, is preferably isolated or shielded from direct contact with the lips by applying the active component onto a tow, sliver or nonwoven fabric which is, in turn, sandwiched within two or more untreated nonwoven fabrics of lesser permeability (Ref. FIG. 3). If desired, the resulting filter element can also be externally coated with cork or similar inert heat insulating material (not shown). The required amount and effectiveness of modifier(s) applied to filter elements in the above way, are determined substantially by substrate width and number of substrates which are fed simultaneously into a garniture, as well as the amount of treated surface physically exposed to cigarette smoke in the filter element.

For purposes of the present invention both treated and combinations of treated and untreated ribbon, open tow, and the like can be wrapped, using regular plug wrap such as paper having a weight within a range of about 25-90 g/m$^2$ or higher, as desired.

The instant invention is illustrated in further detail in FIGS. 1-4, wherein

Figure 2:
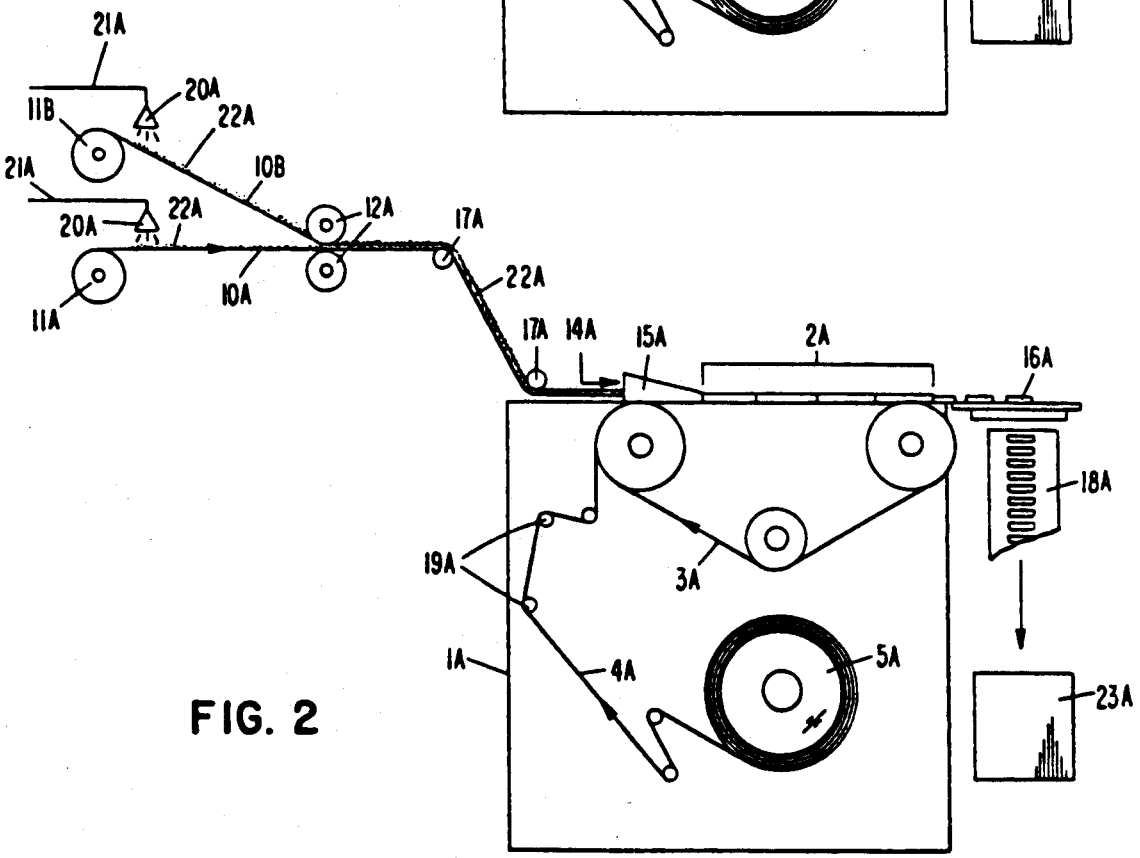
Figure 4:
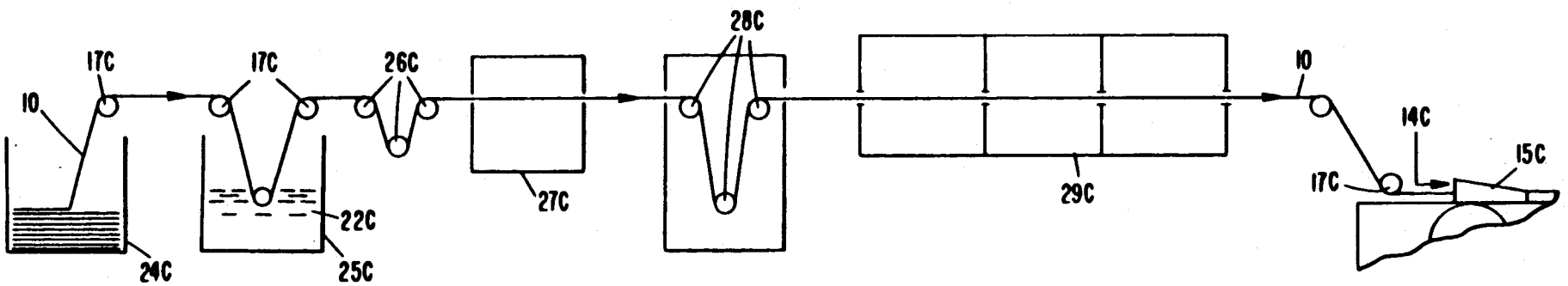

FIG. 1 diagrammatically represents a conventional cigarette filter rod-making apparatus capable of converting substrate and modified substrate, as above described and in accordance with the instant invention, into filter elements;

FIGS. 2-4 diagrammatically represent further modifications and improvements within the instant invention, whereby one or more tows, slivers, ribbons of nonwovens, and fibrillated film are treated with one or more active modifier components by spraying, dipping, or vacuum draw (not shown), the use of multiple substrates in this manner favoring increased filter element bulk and improved crush resistance, or hardness as well as selective filtration.

Referring again to FIG. 1, a single continuous substrate such as opened fiber tow, sliver, fibrillated film or ribbon of nonwoven fabric (10) is fed from feed reel (11) or a bale (not shown) and across one or more opposed spray heads (20) feedably connected to feed lines (21) from outside sources (not shown) to apply one or more active modifier component (22). The resulting treated substrate is then dried by air drying means (not shown) and by passing through drying rolls (12), to obtain the desired degree of dryness, and then led by guide rolls (17) into a garniture trumpet (15) and garniture (14) of a cigarette filter rod manufacturing apparatus (1) comprised of a garniture section (2) including (but not showing) means for shaping and retaining the substrate feed, wrapping means, and cutting means for converting the wrapped plug or rod into filter element (16); the wrapping means is conveniently supplied with tow wrap (4) from wrap feed reel (5) supported by support rolls (19) and moved onto a continuous garniture belt (3) for introduction into the rod-making apparatus.

The apparatus, as described, comprises conventional means for sealing a tow wrap around a filter plug (not shown), the wrapped plug then being cut by cutting means into generally cylindrical filter elements (16) of desired length (normally 90 mm or more), which are removed through filter chute (18) (shown in fragment) for packing in container (23).

FIG. 2 diagrammatically demonstrates a further arrangement for separately applying active modifier component(s) onto a garniture feed comprising substrates (10A) and (10B), whereby differently arranged spray heads (20A) fed by connecting feed lines (21A), separately apply active modifier components (22A) (identical or otherwise) onto the substrates, which are dried using air and heated rolls (12A), before being fed through garniture (14A) of rod-making apparatus (1A), to form filter elements (16A) as before. Substrates 10A and 10B, are separately fed from feed rolls (11A) and (11B) or bales (not shown) and brought into register at heated nip rolls (12A), then guided by guide rolls (17A) into garniture (14A), the garniture feed or substrate components shown being similarly or equivalently defined by use of the same arabic numbers in FIGS. 1-3.

FIG. 3 diagrammatically demonstrates a further modification of the equipment and process of FIGS. 1 and 2, whereby several substrates of the same or different types (10C, 10D, and 10E) as described above from reels or boxes (not shown) are fed through a nip created by heated rolls (12B), the middle substrate (10D) preferably being of different width and having higher absorption or adsorption properties for retaining active components (22B) than the two external untreated substrates (10C and 10E). As shown, substrate (10D) is sprayed on both sides to selectively expose it to one or more active modifier components (22B) applied by spray heads (20B) fed from feedlines (21B), one substrate (10E) preferably being arranged so as to catch surplus drip or misdirected active components not retained or captured by ribbon (10D), all three substrates are then air dried by passing in register through heated nip rolls (12B), as before, and directed by guide rolls (not shown) into the garniture of a filter rod apparatus in the manner of FIGS. 1 and 2.

FIG. 4 is a diagrammatic representation of a further modification in which one or more substrates, as above defined, (shown as 10) are separately fed from a bale or box (24C), passed over guide rolls (17C), and dipped into a reservoir (25C) containing one or more active modifier component(s) (22C) in solution, suspension, or emulsion, and then passed through nip rolls (26C), through a heating oven (27C), drawer rolls (28C), a three step drying oven (29C), then to garniture (14C) of a cigarette rod manufacturing apparatus in the manner of FIGS. 1-3, supra, or boxed and stored for future use.

Where a continuous fiber tow is used as a substrate component, preparation of the tow is conveniently carried out in the usual way by drawing the fiber from one or more creels through a fluid bulking or texturing jet (not shown in figures) and then handled as noted above.

Substrates which are employed in the above manner can usefully comprise a variety of synthetic filaments as noted above. Thus, it is possible to use polyesters, polyamides, acrylics, as well as polypropylene and the like. Due to its relatively low density, compared to other synthetic fiber-forming material and excellent spin properties, combinations of filament-forming copolymers of propylene with ethylene or other lower olefins monomers are particularly preferred as tow, nonwoven ribbon (of monofilament or bicomponent fiber or fiber webs) and fibrillated film material.

The bulk denier of a tow for carrying out the present invention can conveniently fall between about 2,000 and 10,000, and this substrate can be supplied as a crimped fiber from a single creel or bale, or as a composite of several creels or bales combined and passed through a fluid jet simultaneously. For best performance of fiber tow as cigarette filters, however, it is preferred that at least some tow be substantially untwisted and untexturized prior to entering a fluid jet.

The invention is further illustrated by the following Examples:

EXAMPLE 1

(A) Baled 4.5 dpf "y" cross section polypropylene fiber obtained from melt spun isotactic polypropylene having a flow rate of 35.2 gm/10 minutes, is broken, opened, carded, crimped and pulled to form a thin tow ribbon about 12–14 inches in width. The ribbon is drawn, without further treatment, through the garniture of a conventional filter rod-forming apparatus, here identified as model PM-2, obtained from Molins Ltd. of Great Britain, and compressed to form filter plugs which are wrapped with BXT-100 polypropylene film to form 108 mm test filter rods. The rods are then cut into 27 mm lengths of essentially equal weight, and draw*1, some of which are taped onto R. J. Reynolds' Camel Light tobacco plugs, and stored for 48 hours in a humidity cabinet at 55%–65% relative humidity at 22° C.*2; the remaining unattached filters are air dried at 70° C. and stored in the humidity cabinet at 55%–65% relative humidity for 48 hours prior to testing.

*1 All tested filter elements have a resistance to draw (RTD) within the range of 111–136 mm Wg (water gauge). *2 According to CORTESTA Standard Method #10

(B) Total particulate/nicotine determinations are obtained by smoking ten filter/tobacco plug test cigarettes as described in Ex 1A, at a rate of one 35 cc puff-/minute down to 35 mm lengths, using a Borgwaldt smoking machine(*3). The particulate matter in the resulting filtered smoke is trapped on a preweighed Cambridge filter pad, and the pad reweighed after smoking, to determine the amount of particulate matter (TPM) which is passed through each treated or untreated cigarette filter. The Cambridge pad is then soaked overnight in anhydrous isopropyl alcohol, and the extract conventionally tested for nicotine and water content using a GC (gas chromatograph) autosampler*4.

*3 Model # RM-1/G. *4 Hewlett Packard Model HP5890.

(C) Aldehyde determinations are also run on a 10 cigarette sample basis using filter elements of Example 1A by directing a measured volume of filtered cigarette smoke into a collection bottle containing a saturated 2.2N HCl solution of 2,4-dinitrophenylhydrazine (DNPH) and 25 ml methylene chloride; the bottle is shaken for 2 hours, and the phases allowed to separate. Aliquot samples of the methylene chloride phase are then removed by syringe for conventional (HPLC) aldehyde analyses.

Test results of Example 1B and 1C are individually averaged and reported in Table 1 below as S-1 through S-3 and as corresponding C(Control) numbers C-1 through C-3.

TABLE I

| SAMPLE | TREATMENT*5 ACTIVE COMPONENT | % ACETALDEHYDE REMOVED | % ACROLEIN REMOVED | % FORMALDEHYDE REMOVED | NIC*6 TPM (%) PASSED | FILTER*7 COLOR |
|---|---|---|---|---|---|---|
| S-1*9 | 2% PEI + acetic acid (pH 4.5) | 32 | 27 | 79 | 7.2 | SD |
| C-1 | Control | — | — | — | 5.5 | — |
| S-2*9 | 5% PEI + formic acid (pH 8) | 38 | 28 | 56 | 8.2 | D |
| C-2 | Control | — | — | — | 6.3 | — |
| S-3*8 | 5% PEI + formic acid (pH 8) | 27 | 26 | 71 | 9.3 | D |
| C-3 | Control | — | — | — | 4.5 | — |

*5Average/10 test Cigarettes using treated filter elements secured to Reynolds Light tobacco plug.
*6Collected in 2,2NHCl containing DNPH and methylene chloride. Conventional HPLC analysis run on methylene chloride aliqnot.
*7D = Slight discoloration/filter. SD = Significant discoloration/filter.
*8Applied filter modifier onto precrimped polypropylene open tow by using a double-spray, then dried at 55%–65% relative humidity.
*9Filter modifier injected directly into filter and the filter dried at 60° C. for 24 hours then stored for 48 hours at 55%–65% relative humidity.

EXAMPLE 2

A. Test filter elements as described in Example 1 are individually injected with one (1) ml samples of 5% solution of PEI adjusted to a pH of 2, 4, 6, 8, 9 and 10 by dilution with concentrated acetic acid (S-4 through S-8) or formic acid S-9 through S-14; the treated filter elements are then dried and stored under controlled humidity as described in Example 1.

B. Unattached filter elements described in Example 2A are endwise secured by air-tight connection to Tygon tubes on one side through a check value to a gas bag containing a 5 ppm acetaldehyde/air mixture, and on the opposite side to a Borgwaldt smoking machine*3 adjusted for five two (2) second 35 cc puffs over a ten (10) minute period. The filtered test gas is collected in a gas sampling loop and analyzed at 150° C. using a Varian 3300 model gas chromatographer equipped with a flame ionization detector to determine the through concentration.

*3 Model # RM-1/G.

Test results are tabulated, using a Varian Model 4290 integrator and reported in Table II as S-4 through S-14.

TABLE II

| Filter Modifier | Sample | pH | % Acetaldehyde Removed | Acetaldehyde Passed (ppm) |
|---|---|---|---|---|
| HAc/PEI | S-4 | 4 | 50 | 2.5 |
| — | Control | — | — | 5.0 |
| HAc/PEI | S-5 | 6 | 50 | 2.4+ |
| — | Control | — | — | 5.0 |
| HAc/PEI | S-6 | 8 | 45 | 3.7+ |
| — | Control | — | — | 5.0 |
| HAc/PEI | S-7 | 9 | 40 | 3.0 |
| — | Control | — | — | 5.0 |
| HAc/PEI | S-8 | 10 | 26 | 3.7 |
| — | Control | — | — | 5.0 |
| Formic/PEI | S-9 | 2 | 23 | 3.8+ |
| — | Control | — | — | 5.0 |
| Formic/PEI | S-10 | 4 | 49 | 2.5+ |
| — | Control | — | — | 5.0 |
| Formic/PEI | S-11 | 6 | 71 | 1.4+ |
| — | Control | — | — | 5.0 |
| Formic/PEI | S-12 | 8 | 76 | 1.2 |

TABLE II-continued

| Filter Modifier | Sample | pH | % Acetaldehyde Removed | Acetaldehyde Passed (ppm) |
|---|---|---|---|---|
| — | Control | — | — | 5.0 |
| Formic/PEI | S-13 | 9 | 51 | 2.4+ |
| — | Control | — | — | 5.0 |
| Formic/PEI | S-14 | 10 | 24 | 3.8 |
| — | Control | — | — | 5.0 |

EXAMPLE 3

Example 2 is repeated but using filter elements injected respectively with 1 ml of 5% PEI modified by formic, propionic, butyric, benzoic, lactic, or acetic acids to pH values of 8 or 6. The dried and stored filter elements are processed as described in Example 2A and secured to a test gas bag (5 ppm acetaldehyde/air) and a Borgwaldt smoking machine*3 as described in Example 2B. Test results are collected as before and reported in Table III.

*3 Model # RM-1/G.

TABLE III

| SAMPLE | TREATMENT*8 ACTIVE COMPONENT | % Acetaldehyde Removed | Acetaldehyde Passed (ppm) |
|---|---|---|---|
| S-1 | 5% PEI + formic acid (pH 8) | 80 | 1.0 |
| Control | — | — | 5.0 |
| S-2 | 5% PEI + propionic acid (pH 6) | 65 | 1.7+ |
| Control | — | — | 5.0 |
| S-3 | 5% PEI + butyric acid (pH 6) | 53 | 2.3+ |
| Control | — | — | 5.0 |
| S-4 | 5% PEI + benzoic acid (pH 6) | 19 | 4.0+ |
| Control | — | — | 5.0 |
| S-5 | 5% PEI + lactic acid (pH 6) | 44 | 2.8 |
| Control | — | — | 5.0 |
| S-6 | 5% PEI + acetic acid (pH 8) | 50 | 2.5 |
| Control | — | — | 5.0 |

What is claimed is:

1. A process for improving appearance plus selective aldehyde filter retention and selective nicotine pass through properties of a cigarette filter element comprising filter substrate in the form of at least one of synthetic thermoplastic fiber- and/or film-containing substrate material, comprising (a) directly treating said filter substrate with an effective amount of a modifier composition comprising
(1) polyethyleneimine together with
(2) an organic acid selected from at least one of the group consisting of formic, propionic, butyric, lactic, benzoic, and acetic acid;
in an amount sufficient to obtain a buffered composition within a pH range of about pH 8 to about pH 9.5; and (b) completing fabrication of the desired filter element;

whereby selective filter retention of aldehyde smoke components and selective filter pass through of nicotine smoke components are promoted in combination.

2. The process of claim 1 wherein the cigarette filter element is fabricated from substrate material in the form of at least one of (a) opened fiber tow, (b) ribbon of nonwoven material, (c) a sliver, or fibrillated film.

3. A cigarette filter element obtained in accordance with the process of claim 2.

4. The process of claim 1 wherein said substrate material comprises about 5%-100% by weight of a polyolefin.

5. The process of claim 4 wherein said substrate material comprises polyethylene/polypropylene sheath-/core bicomponent fiber.

6. A cigarette filter element obtained in accordance with the process of claim 5.

7. A cigarette filter element obtained in accordance with the process of claim 4.

8. The process of claim 1 wherein said substrate material comprises up to 90% by weight of cellulose acetate.

9. A cigarette filter element obtained in accordance with the process of claim 8.

10. The process of claim 1 wherein the organic acid is formic acid.

11. A cigarette filter element obtained in accordance with the process of claim 10.

12. The process of claim 1 wherein the organic acid is propionic acid.

13. A cigarette filter element obtained in accordance with the process of claim 12.

14. The process of claim 1, wherein the organic acid is butyric acid.

15. A cigarette filter element obtained in accordance with the process of claim 14.

16. The process of claim 1 wherein the organic acid is benzoic acid.

17. A cigarette filter element obtained in accordance with the process of claim 16.

18. The process of claim 1 wherein the organic acid is lactic acid.

19. A cigarette filter element obtained in accordance with the process of claim 18.

20. The process of claim 1 wherein the organic acid is acetic acid.

21. A cigarette filter element obtained in accordance with the process of claim 20.

22. A cigarette filter element obtained in accordance with the process of claim 1.

23. A cigarette comprising a tobacco plug and a filter element obtained in accordance with claim 22.

24. A process of claim 1 wherein the organic acid is formic acid or butyric acid.

* * * * *